US006691489B2

(12) United States Patent
Frame

(10) Patent No.: US 6,691,489 B2
(45) **Date of Patent: *Feb. 17, 2004**

(54) METHOD OF INSTALLING ROOFING SHINGLES

(76) Inventor: Craig Frame, 1542 Sierra Alta, Santa Ana, CA (US) 92705

( * ) Notice: Subject to any disclaimer, the term of this patent is extended or adjusted under 35 U.S.C. 154(b) by 0 days.

This patent is subject to a terminal disclaimer.

(21) Appl. No.: 10/170,797

(22) Filed: Jun. 11, 2002

(65) Prior Publication Data

US 2002/0148197 A1 Oct. 17, 2002

Related U.S. Application Data

(63) Continuation of application No. 09/377,321, filed on Aug. 19, 1999, now Pat. No. 6,401,425.
(60) Provisional application No. 60/098,252, filed on Aug. 28, 1998.

(51) Int. Cl.[7] ..... E04D 1/00
(52) U.S. Cl. ..... 52/748.1; 52/518
(58) Field of Search ..... 52/748.1, 518, 52/520

(56) References Cited

U.S. PATENT DOCUMENTS

| | | | | |
|---|---|---|---|---|
| 3,998,685 | A | 12/1976 | Czyzewski et al. | |
| D247,786 | S | 4/1978 | Flood | |
| 4,266,388 | A | 5/1981 | Flood | |
| 4,729,814 | A | 3/1988 | Jennus et al. | |
| 4,775,440 | A | 10/1988 | Jennus et al. | |
| 4,869,942 | A | 9/1989 | Jennus et al. | |
| 5,052,162 | A | 10/1991 | Bush et al. | |
| 6,401,425 | B1 * | 6/2002 | Frame | 52/748.1 |

OTHER PUBLICATIONS

Celotex, Residential Roofing Technical Bulletin, dated 1/98, No. 771a, Dual Color Application Methods.

Celotex, Residential Roofing Technical Bulletin, dated 1/98, No. 769a, Directions for Application.

* cited by examiner

*Primary Examiner*—Robert W. Gibson, Jr.
(74) *Attorney, Agent, or Firm*—Knobbe Martens Olson & Bear LLP

(57) ABSTRACT

A method of installing differently colored roofing shingles to create the appearance of a substantially random colored pattern. The method includes the selection of at least two colors of roofing shingles. The shingles are installed in a plurality of rows on a roofing substrate in a repetitive pattern. Advantageously, the method creates a visually aesthetic roof at a desirably low cost.

1 Claim, 5 Drawing Sheets

METHOD OF INSTALLING ROOFING SHINGLES

REFERENCE TO PRIOR APPLICATION

This Application is a continuation of U.S. patent application Ser. No. 09/377,321 filed Aug. 19, 1999 now U.S. Pat. No. 6,401,425 and is related to and claims the benefit of U.S. Provisional Application Serial No. 60/098,252 filed Aug. 28, 1998.

BACKGROUND OF THE INVENTION

1. Field of the Invention

The present invention relates to the field of roofing shingles, and, in particular, to a method of installing differently colored roofing shingles to achieve the appearance of a randomly colored pattern.

2. Background of the Related Art

Nowadays, it is very popular to use differently colored shingles as a roofing material. In many cases, these shingles are arranged in a predetermined color based format which results in the creation of a substantially distinct and ordered color pattern. Though this process is relatively simple and expeditious, the appearance of a distinct and ordered color pattern on a roof can be aesthetically displeasing and, hence, undesirable.

Alternatively, differently colored shingles may be individually selected and arranged in a random format to achieve the appearance of a substantially random color pattern. Those of ordinary skill in the art will readily recognize that, disadvantageously, this can be a very time consuming process. As a result, the cost of labor and craftsmanship associated with employing such a time consuming method can be undesirably high.

Thus, there is a need for a simple and expeditious method of installing differently colored roofing shingles to create the appearance of a substantially random color pattern, thereby creating a visually aesthetic roof at a desirably low cost.

SUMMARY OF THE INVENTION

A method of installing roofing shingles in accordance with the present invention overcomes the above-mentioned disadvantages by incorporating a conventional shingle installation format in conjunction with a substantially simple row-based color selection scheme. Preferably, the method is used in installing roofing material which is substantially the same as Celotex Presidential® roofing shingles and includes the selection of at least two colors of roofing shingles. The shingles are preferably installed in a plurality of rows on a roofing substrate in a repetitive pattern that provides the appearance, when installed, of a substantially random pattern of at least two colors.

In a first preferred embodiment of the method of the present invention, two colors of roofing shingles are selected. A first row of shingles, comprising substantially only the first of the two colors, is installed on the roofing substrate. A second row of shingles is installed adjacent to the first row, in a conventional installation format, and comprises substantially only the second of the two colors. A third row of shingles is installed adjacent to the second row, in a conventional installation format, wherein the third row is a substantially periodic alternating pattern of the two colors. The shingle installation sequence for the first three rows is generally repeated for the subsequent rows.

In a second preferred embodiment of the method of the present invention, two colors of roofing shingles are selected. A first row of shingles, comprising substantially only the first of the two colors, is installed on the roofing substrate. A second row of shingles is installed adjacent to the first row, in a conventional installation format, wherein the second row is a substantially periodic alternating pattern of the two colors. A third row of shingles is installed adjacent to the second row, in a conventional installation format, and comprises substantially only the second of the two colors. A fourth row of shingles is installed adjacent to the third row, in a conventional installation format, wherein the fourth row is a substantially periodic alternating pattern of the two colors. The shingle installation sequence for the first four rows is generally repeated for the subsequent rows.

In a third preferred embodiment of the method of the present invention, three colors of roofing shingles are selected. A first row of shingles, comprising substantially only the first of the three colors, is installed on the roofing substrate. A second row of shingles is installed adjacent to the first row, in a conventional installation format, wherein the second row is a substantially periodic alternating pattern of at least two of the three colors. A third row of shingles is installed adjacent to the second row, in a conventional installation format, and comprises substantially only the second of the three colors. A fourth row of shingles is installed adjacent to the third row, in a conventional installation format, wherein the fourth row is a substantially periodic alternating pattern of at least two of the three colors. A fifth row of shingles is installed adjacent to the fourth row, in a conventional installation format, and comprises substantially only the third of the three colors. A sixth row of shingles is installed adjacent to the fifth row, in a conventional installation format, wherein the sixth row is a substantially periodic alternating pattern of at least two of the three colors. The shingle installation sequence for the first six rows is generally repeated for the subsequent rows.

Those of ordinary skill in the art will readily recognize the utility of the present invention. Advantageously, the roofing shingle installation method of the present invention creates the appearance of a substantially random color pattern, thereby creating a visually aesthetic roof at a desirably low cost.

Other specific provisions and advantages of the present invention will become apparent from a reading and study of the specification, claims and figures. As will be realized by those skilled in the art the invention is capable of modifications in various respects, all without departing from the scope and utility of the invention as disclosed herein. Accordingly the specification and figures should be regarded as illustrative in nature, and not as restrictive.

DETAILED DESCRIPTION OF THE PREFERRED EMBODIMENTS

Figure 1:
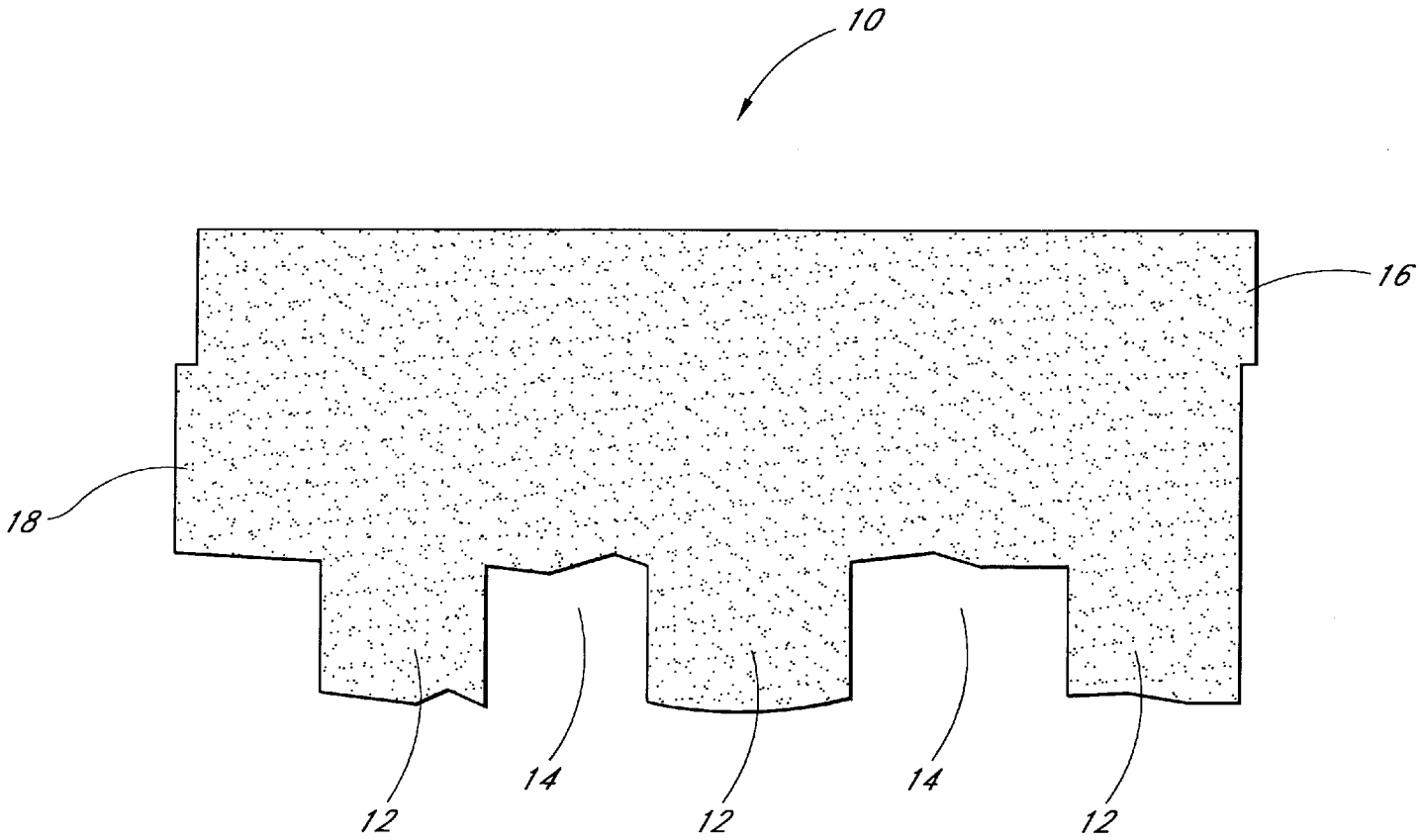
FIG. 1 illustrates a roofing shingle similar to a typical Celotex Presidential® roofing shingle.

The method of the present invention is used to install a roofing material which is substantially the same as Celotex Presidential® shingles. FIG. 1 illustrates a typical Celotex Presidential® shingle 10 having a generally rectangular shape with a plurality of teeth 12 and a plurality of slots 14. Although FIG. 1 depicts three "teeth," such shingles may have four or more "teeth" as well. These teeth are the significant feature of the shingles used in connection with the present invention to permit the desired effect. The shingle 10 may have a pair of spaced tabs 16 and 18 which facilitate in positioning the shingles in rows.

Figure 2:
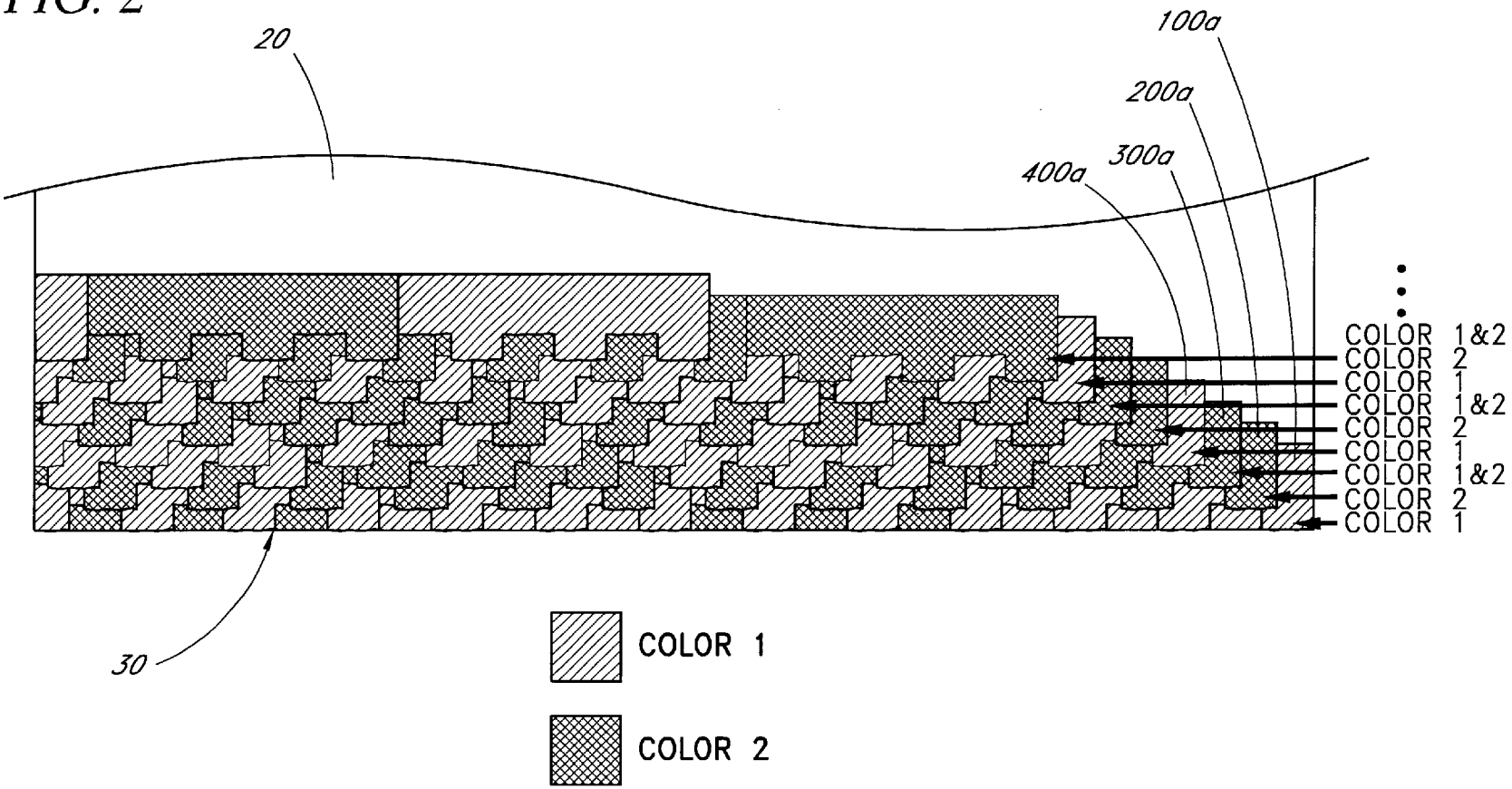
FIG. 2 schematically illustrates a substantially random looking color pattern formed by differently colored shingles in accordance with a first preferred embodiment of the method of the present invention.
Figure 3:
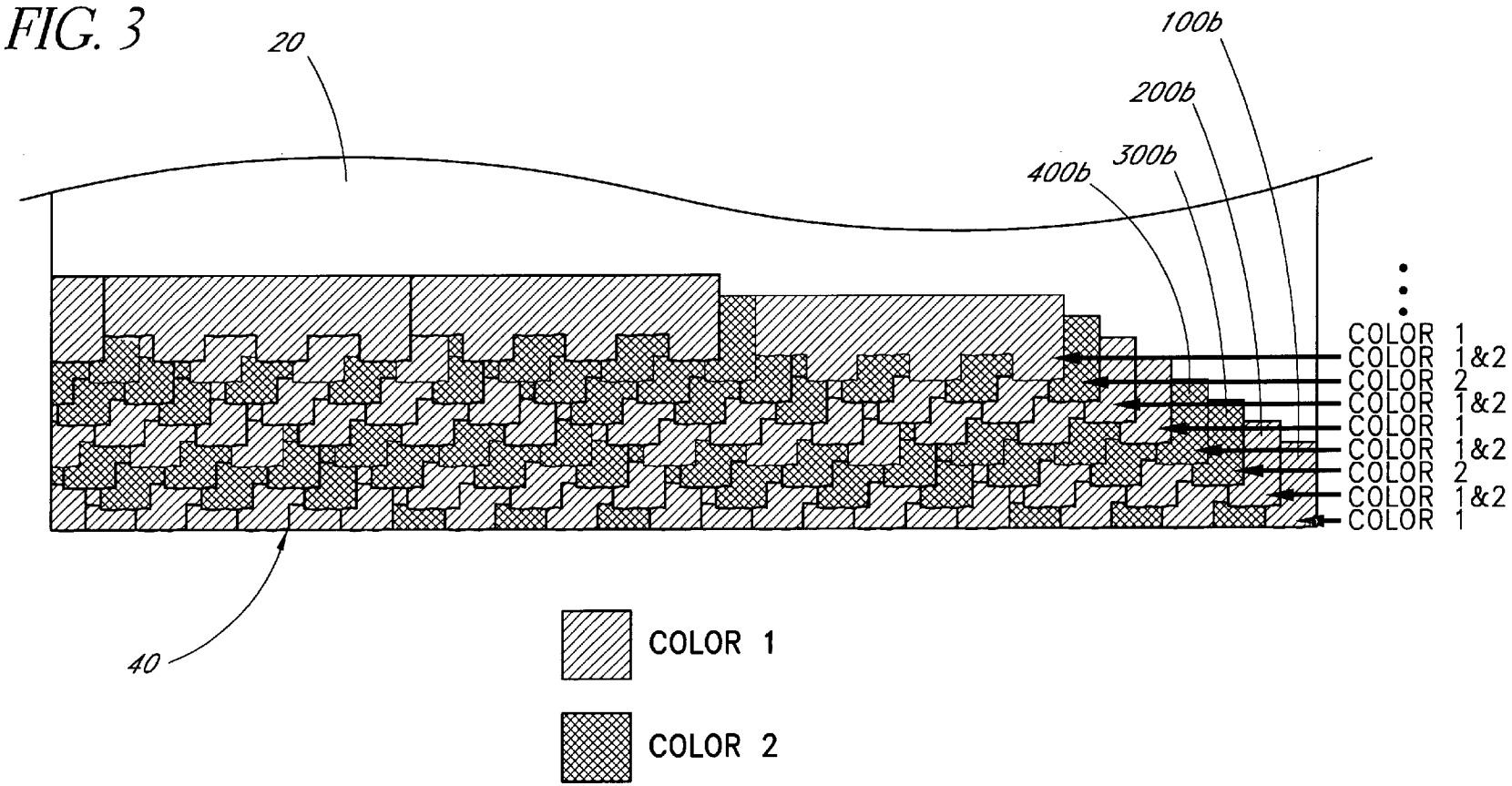
FIG. 3 schematically illustrates a substantially random looking color pattern formed by differently colored shingles in accordance with a second preferred embodiment of the method of the present invention.
Figure 4A:
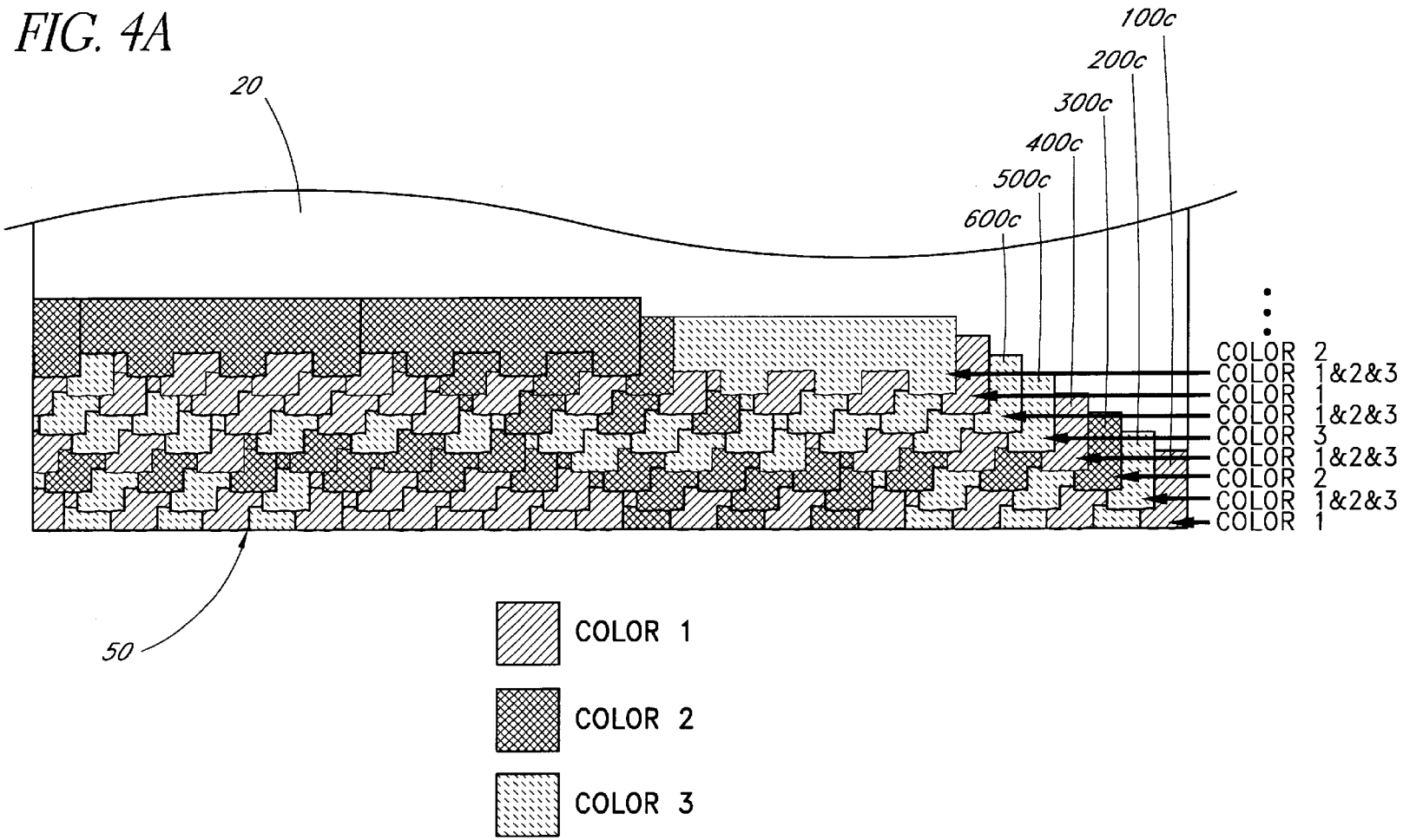
FIG. 4A schematically illustrates a substantially random looking color pattern formed by differently colored shingles in accordance with a third preferred embodiment of the method of the present invention.
Figure 4B:
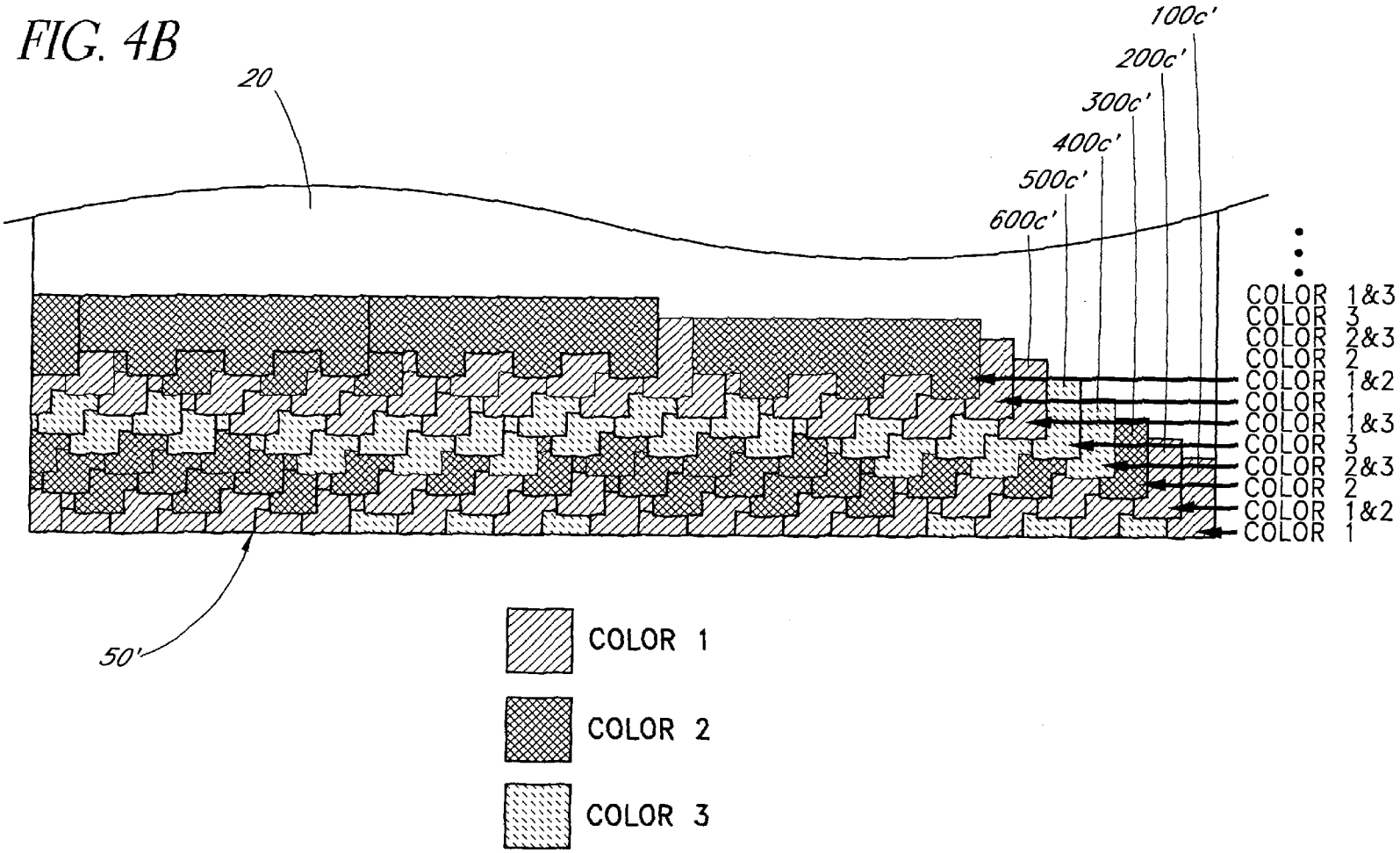
FIG. 4B schematically illustrates a substantially random looking color pattern formed by differently colored shingles in accordance with another preferred third embodiment of the method of the present invention.

The method of the present invention includes the selection of at least two colors of roofing shingles 10, for example, colors 1, 2, 3 as shown in FIGS. 2, 3, 4A and 4B. The shingles 10 are installed in a plurality of rows on a roofing substrate 20 (shown schematically in FIGS. 2, 3, 4A and 4B). The installation follows a repetitive pattern that provides the appearance, when the shingles 10 are installed, of a substantially random colored pattern, such as the patterns 30 (FIG. 2), 40 (FIG. 3), 50 (FIG. 4A) and 50' (FIG. 4B). The method of the present invention may be practiced in a wide variety of combinations, though a few preferred embodiments are discussed in greater detail herein below.

First Preferred Embodiment

In a first preferred embodiment of the method of the present invention, illustrated in FIG. 2, two colors 1 and 2 of roofing shingles 10 are selected. A first row 100*a* of shingles 10 is installed on the roofing substrate 20; the first row 100*a* comprises shingles 10 of substantially only the color 1. A second row 200*a* of shingles 10 is installed adjacent to the first row 100*a*, in a conventional installation format, and comprises substantially only the shingles 10 of the color 2. Those skilled in the art will be aware that the conventional installation format referred to typically involves installing shingles 10 of row 200*a* overlappingly adjacent to row 100*a* and offset with respect to the shingles 10 of the row 100*a*. Of course, shingles 10 at the edges of the roofing substrate 20 may require trimming to define a generally smooth boundary, as is well known in the art. A third row 300*a* of shingles 10 is installed adjacent to the second row 200*a*, in a conventional installation format, wherein the third row 300*a* is a substantially periodic alternating pattern of the colors 1 and 2. Preferably, the shingles 10 of the third row 300*a* are installed by alternating one shingle of color 1 with one shingle of color 2, as is illustrated in FIG. 2, though other substantially periodic alternating patterns of the colors 1 and 2 may be employed with efficacy. Alternatively, the shingles 10 of row 300*a* may be arranged in a substantially random pattern of colors 1 and 2.

Preferably, the shingle installation sequence for the first three rows 100*a*, 200*a*, 300*a* is generally repeated for the subsequent corresponding rows, as is illustrated in FIG. 2, to create a pattern 30 that provides the appearance of a substantially random pattern 30 of the colors 1 and 2. Alternatively, the scope of the present invention permits that the subsequent rows corresponding to the third row 300*a* may be patterned in a variety of substantially periodic alternating or random patterns of the colors 1 and 2 which may differ not only from one another but also from the pattern of the third row 300*a*.

Second Preferred Embodiment

In a second preferred embodiment of the method of the present invention, illustrated in FIG. 3, two colors 1 and 2 of roofing shingles 10 are selected. A first row 100*b* of shingles 10 is installed on the roofing substrate 20; the first row 100*b* comprises shingles 10 of substantially only the color 1. A second row 200*b* of shingles 10 is installed adjacent to the first row 100*b*, in a conventional installation format, wherein the second row 200*b* is a substantially periodic alternating pattern of the colors 1 and 2. A third row 300*b* of shingles 10 is installed adjacent to the second row 200*b*, in a conventional installation format, and comprises substantially only the shingles 10 of the color 2. A fourth row 400*b* of shingles 10 is installed adjacent to the third row 300*b*, in a conventional installation format, wherein the fourth row 400*b* is a substantially periodic alternating pattern of the colors 1 and 2.

Preferably, the shingles 10 of the second row 200*b* and the fourth row 400*b* are installed by alternating one shingle of color 1 with one shingle of color 2, as is illustrated in FIG. 3, though other substantially periodic alternating patterns of the colors 1 and 2 may be employed with efficacy. Alternatively, the shingles 10 of the row 200*b* and/or the row 400*b* may be arranged in a substantially random pattern of colors 1 and 2.

Preferably, the shingle installation sequence for the first four rows 100*b*, 200*b*, 300*b*, 400*b* is generally repeated for the subsequent corresponding rows, as is illustrated in FIG. 3, to create a pattern 40 that provides the appearance of a substantially random pattern 40 of the colors 1 and 2. Alternatively, the scope of the present invention permits that the subsequent rows corresponding to the second row 200*b* and to the fourth row 400*b* may be patterned in a variety of substantially periodic alternating or random patterns of the colors 1 and 2 which may differ not only from one another but also from the respective patterns of the second row 200*b* and of the fourth row 400*b*.

Third Preferred Embodiment

In a third preferred embodiment of the method of the present invention, illustrated in FIGS. 4A and 4B with each figure illustrating one preferred form of the third embodiment, three colors 1, 2 and 3 of roofing shingles 10 are selected. Referring to FIG. 4A (or FIG. 4B, with like numbers), a first row 100*c* of shingles 10 is installed on the roofing substrate 20; the first row 100*c* comprises shingles 10 of substantially only the color 1. A second row 200*c* of shingles 10 is installed adjacent to the first row 100*c*, in a conventional installation format, wherein the second row 200*c* is a substantially periodic alternating pattern of at least two of the colors 1, 2 and 3. A third row 300*c* of shingles 10 is installed adjacent to the second row 200*c*, in a conventional installation format, and comprises substantially only the shingles 10 of the color 2. A fourth row 400*c* of shingles 10 is installed adjacent to the third row 300*c*, in a conventional installation format, wherein the fourth row 400*c* is a substantially periodic alternating pattern of at least two of the colors 1, 2 and 3. A fifth row 500*c* of shingles 10 is installed adjacent to the fourth row 400*c*, in a conventional installation format, and comprises substantially only the shingles 10 of the color 3. A sixth row 600*c* of shingles 10 is installed adjacent to the fifth row 500*c*, in a conventional installation format, wherein the sixth row 600*c* is a substantially periodic alternating pattern of at least two of the colors 1, 2 and 3.

In one preferred form of the third embodiment of the present invention, as illustrated in FIG. 4A, all three colors 1, 2, 3 of shingles 10 are used in each one of the rows 200*c*,

400*c*, 600*c*. Preferably, the shingles 10 of the second row 200*c*, fourth row 400*c* and sixth row 600*c* are installed by alternating a set of three shingles 10 formed by a shingle of color 1, a shingle of color 2 and a shingle of color 3, arranged in that order, as can be seen in FIG. 4B.

In another preferred form of the third embodiment of the present invention, as illustrated in FIG. 4B, only two of the three colors 1, 2, 3 of shingles 10 are used in each one of the rows 200*c*, 400*c*, 600*c*. Preferably, the shingles 10 of the second row 200*c* are installed by alternating one shingle of color 1 with one shingle of color 2, the shingles 10 of the fourth row 400*c* are installed by alternating one shingle of color 2 with one shingle of color 3, and the shingles 10 of the sixth row 600*c* are installed by alternating one shingle of color 3 with one shingle of color 1, as can be seen in FIG. 4B.

Though FIGS. 4A and 4B each illustrate a particular preferred periodic alternating pattern of at least two of the three colors 1, 2 and 3, as installed in the multicolored rows 200*c*, 400*c*, 600*c* of the pattern 50 (FIG. 4A) and the multi-colored rows 200*c*', 400*c*', 600*c*' of the pattern 50' (FIG. 4B), other substantially periodic alternating patterns of at least two of the three colors 1, 2 and 3 may be employed with efficacy in installation of the above-mentioned multi-colored rows. Alternatively, the shingles 10 of one or more of the above-mentioned multi-colored rows may be arranged in a substantially random pattern of at least two of the three colors 1, 2 and 3.

Preferably, the shingle installation sequence for the first six rows 100*c*, 200*c*, 300*c*, 400*c*, 500*c*, 600*c* of FIG. 4A is generally repeated for the subsequent corresponding rows, as is illustrated in FIG. 4A, to create a pattern 50 that provides the appearance of a substantially random pattern 50 of the colors 1, 2 and 3. Alternatively, the scope of the present invention permits that the subsequent rows corresponding to the second row 200*c*, the fourth row 400*c* and the sixth row 600*c* may be patterned in a variety of substantially periodic alternating or substantially random patterns of at least two of the three colors 1, 2 and 3 which may differ not only from one another but also from the respective patterns of the second row 200*c*, the fourth row 400*c* and the sixth row 600*c*.

Similarly, preferably, the shingle installation sequence for the first six rows 100*c*', 200*c*', 300*c*', 400*c*', 500*c*', 600*c*' of FIG. 4B is generally repeated for the subsequent corresponding rows, as is illustrated in FIG. 4B, to create a pattern 50' that provides the appearance of a substantially random pattern 50' of the colors 1, 2 and 3. Alternatively, the scope of the present invention permits that the subsequent rows corresponding to the second row 200*c*', the fourth row 400*c*' and the sixth row 600*c*' may be patterned in a variety of substantially periodic alternating or substantially random patterns of at least two of the three colors 1, 2 and 3 which may differ not only from one another but also from the respective patterns of the second row 200*c*', the fourth row 400*c*' and the sixth row 600*c*'.

The utility of the present invention will be readily apparent to those skilled in the art. Advantageously, the roofing shingle installation method of the present invention creates the appearance of a substantially random color pattern, thereby creating a visually aesthetic roof at a desirably low cost.

While the method of the present invention has been described with a certain degree of particularity, it is manifest that many changes may be made in the specific methodology, designs and constructions hereinabove described without departing from the spirit and scope of this disclosure. It is understood that the invention is not limited to the embodiments set forth herein for purposes of exemplification, but is to be defined only by a fair reading of the appended claims, including the full range of equivalency to which each element thereof is entitled.

What is claimed is:

1. A method of installing roofing shingles having a plurality of spaced teeth to provide a random appearance, said method comprising the steps of:

selecting at least two different colors of said roofing shingles; and installing said shingles in a plurality of rows on a roofing substrate in a repetitive pattern that provides the appearance, when installed, of a substantially random pattern of said at least two colors.

* * * * *